US006963262B2

(12) United States Patent
Mayfield

(10) Patent No.: US 6,963,262 B2
(45) Date of Patent: Nov. 8, 2005

(54) REDUCTION OF CAPACITANCE EFFECTS IN POTENTIAL TRANSFORMERS

(75) Inventor: Glenn A. Mayfield, West Lafayette, IN (US)

(73) Assignee: Radian Research, Inc., Lafayette, IN (US)

( * ) Notice: Subject to any disclaimer, the term of this patent is extended or adjusted under 35 U.S.C. 154(b) by 195 days.

(21) Appl. No.: 10/380,398

(22) PCT Filed: Sep. 11, 2001

(86) PCT No.: PCT/US01/42115

§ 371 (c)(1),
(2), (4) Date: Mar. 12, 2003

(87) PCT Pub. No.: WO02/23707

PCT Pub. Date: Mar. 21, 2002

(65) Prior Publication Data

US 2004/0004524 A1 Jan. 8, 2004

Related U.S. Application Data

(60) Provisional application No. 60/233,183, filed on Sep. 15, 2000.

(51) Int. Cl.[7] ..... H01F 27/02
(52) U.S. Cl. ..... 336/84 R; 336/84 C
(58) Field of Search ..... 336/84 R, 84 C, 336/84 M, 180–183

(56) References Cited

U.S. PATENT DOCUMENTS 3,153,758 A 10/1964 Kusters et al.
3,500,171 A 3/1970 Kusters et al.
3,534,247 A 10/1970 Miljanic
3,651,760 A * 3/1972 Held ..... 102/218
4,333,900 A * 6/1982 Carey ..... 264/85
4,841,236 A 6/1989 Miljanic et al.
4,888,545 A 12/1989 Celenza et al.
4,916,599 A * 4/1990 Traxler et al. ..... 363/65
5,216,364 A 6/1993 Ko et al.
5,235,217 A 8/1993 Kirton
5,276,394 A 1/1994 Mayfield
5,307,008 A 4/1994 So
5,875,103 A 2/1999 Bhagwat et al.

FOREIGN PATENT DOCUMENTS

JP 63-158822 * 7/1988

* cited by examiner

*Primary Examiner*—Tuyen T Nguyen
(74) *Attorney, Agent, or Firm*—Barnes & Thornburg LLP

(57) ABSTRACT

A transformer includes a first winding and a second winding coupled to the first winding through a magnetic circuit so that current through the first winding induces a voltage across the second winding. The first winding includes n separate shield portions, where n is an integer. Each of the n shield portions shields only a corresponding portion of the first winding. Each of the n shield portions is electrically coupled to the adjacent shield portion(s) substantially only through its coupling to the first winding, the first winding, and the other(s) of the adjacent shield portion's (s') coupling (s) to the first winding.

21 Claims, 11 Drawing Sheets

REDUCTION OF CAPACITANCE EFFECTS IN POTENTIAL TRANSFORMERS

CROSS-REFERENCE TO RELATED APPLICATIONS

This application is a U.S. national counterpart application of international application Ser. No. PCT/US01/42115 filed Sep. 11, 2001, which claims priority to U.S. provisional application Ser. No. 60/233,183 filed Sep. 15, 2000.

FIELD OF THE INVENTION

This invention relates to potential transformers, and is directed toward methods and apparatus for improving the measurement and calibration accuracy of potential transformers.

BACKGROUND OF THE INVENTION

Potential transformers are used to multiply or divide voltages precisely for the purpose of measurement or calibration. An ideal potential transformer 20 is illustrated schematically in FIG. 1. An ideal voltage source 22 is connected to transformer 20. The input voltage is $v_i(t)$ and the output voltage is $v_o(t)$. The output voltage $v_o(t)$ is proportional to the input voltage $v_i(t)$ by the turns ratio, n. Thus, $v_o(t)=nv_i(t)$. The turns ratio n may be larger or smaller than one. For n larger than one, the transformer is a step-up transformer. For n less than one, the transformer is a step-down transformer. Of course, ideal transformers 20 and voltage sources 22 do not exist. Real world, non-ideal transformers exhibit such phenomena as common mode signal injection, winding resistance, winding-to-winding capacitance, winding-to-electrostatic shield capacitance, turn-to-turn and layer-to-layer capacitance, core loss, and magnetizing inductance.

FIG. 2 illustrates a typical model for a non-ideal potential transformer 24 and voltage source 26. The transformer in the, model is an ideal 1:n transformer. An electrostatic shield 32 is illustrated between the primary and secondary windings 28, 30 to eliminate electrostatic coupling between the transformer's primary winding 28 and secondary winding 30. $R_g$ models the resistance of the non-ideal voltage source 26. $R_p$ models the resistance of the primary windings 28. $R_s$ models the resistance of the secondary windings 30. $C_p$ models the turn-to-turn or layer-to-layer capacitance associated with the primary windings 28. $C_s$ models the turn-to-turn or layer-to-layer capacitance associated with the secondary windings 30. $C_{sh1}$ models the winding 28-to-shield 32 capacitance associated with the primary windings 28. $C_{sh2}$ models the winding 30-to-shield 32 capacitance associated with the secondary windings 30. $R_c$ models the core loss associated with the transformer 24 core. $L_m$ models the magnetizing inductance associated with the transformer 24 core. Ideal voltage source $v_c(t)$ models the voltage associated with common mode signal injection. It should be understood that $R_g$, $R_p$, $R_s$, $R_c$, $C_p$, $C_s$, $C_{sh1}$, $C_{sh2}$, and $L_m$ are all lumped parameter approximations of what are actually distributed values.

As can be appreciated from FIG. 2, current flow through $R_c$, $C_p$, $C_s$, $C_{sh1}$, $C_{sh2}$, $L_m$, $R_g$ and $R_p$ causes errors in the output of the potential transformer 24. Additional error is caused by current flow in $C_s$, and $C_{sh2}$, which induces additional voltage drop across $R_s$.

DISCLOSURE OF THE INVENTION

According to one aspect of the invention, a transformer includes a first winding and a second winding coupled to the first winding through a magnetic circuit so that voltage applied across the first winding induces a voltage across the second winding. The first winding includes at least first and second separate shield portions. The first shield portion shields only a first portion of the first winding. The second shield portion shields only a second portion of the first winding. Each of the first and second shield portions is electrically coupled to the other of the first and second shield portions substantially only through its coupling to the first winding, the first winding, and the other of the first and second shield portions' coupling to the first winding.

Illustratively according to this aspect of the invention, the apparatus includes n separate shield portions, where n is an integer. Each of the n shield portions is electrically coupled to another of the n shield portions substantially only through its coupling to the first winding, the first winding and the other of the n shield portions' coupling to the first winding.

Further illustratively according to this aspect of the invention, the apparatus includes a source for exciting the first winding. The source has an output impedance. The first winding has an input impedance. The output impedance is at least about an order of magnitude less than the input impedance at an output frequency of the source.

Additionally illustratively according to this aspect of the invention, the output impedance is at least about two orders of magnitude less than the input impedance at the output frequency.

Illustratively according to this aspect of the invention, the source includes a source for coupling directly to the first and second shield portions.

Further illustratively according to this aspect of the invention, the apparatus includes a third shield portion. The third shield portion substantially shields the second winding from the first winding. The third shield portion is coupled to a reference potential.

Additionally illustratively according to this aspect of the invention, the apparatus includes n separate shield portions, where n is an integer. A series capacitive voltage divider includes (n−1) capacitances. Each of the (n−1) capacitances couples a respective pair of adjacent shield portions. Each of the n shield portions is electrically coupled to an adjacent one of the n shield portions substantially only through its coupling to the first winding, the first winding, and the adjacent one of the n shield portions' coupling to the first winding, and through a respective one of the (n−1) capacitances.

Further illustratively according to this aspect of the invention, the apparatus includes a source for exciting the first winding. The first winding and the series capacitive voltage divider are coupled across the source.

Illustratively according to this aspect of the invention, the apparatus includes a first source for exciting the first winding and a second source. The first winding is coupled across the first source and the capacitive voltage divider is coupled across the second source.

Illustratively according to this aspect of the invention, the second source includes an amplifier.

Additionally illustratively according to this aspect of the invention, the amplifier includes a voltage follower amplifier.

Further illustratively according to this aspect of the invention, the apparatus includes n separate shield portions, where: n is an integer, and n sources. Each of the n sources is coupled to a respective one of the n separate shield portions.

Illustratively according to this aspect of the invention, each of the (n−1) additional sources includes an amplifier.

Additionally illustratively according to this aspect of the invention, the first winding includes n separate shield portions, where n is an integer. A series capacitive voltage divider includes (n−1) capacitances. Each of the (n−1) capacitances couples a respective pair of adjacent shield portions of the first winding.

Each of the n shield portions of the first winding is electrically coupled to an adjacent one of the n shield portions of the first winding substantially only through its coupling to the first winding, the first winding, and the adjacent one of the n shield portions' coupling to the first winding, and through a respective one of the (n−1) capacitances. The second winding includes m separate shield portions, where m is an integer. A series capacitive voltage divider includes (m−1) capacitances. Each of the (m−1) capacitances couples a respective pair of adjacent shield portions of the second winding. Each of the m shield portions of the second winding is electrically coupled to an adjacent one of the m shield portions of the second winding substantially only through its coupling to the second winding, the second winding, and the adjacent one of the m shield portions' coupling to the second winding, and through a respective one of the (m−1) capacitances.

Further illustratively according to this aspect of the invention, the apparatus includes a source for coupling across the (m−1) series voltage divider capacitances.

Additionally illustratively according to this aspect of the invention, the apparatus includes a source for coupling across the (n−1) series voltage divider capacitances.

According to another aspect of the invention, a transformer includes a first winding and a second winding coupled to the first winding through a magnetic circuit so that current through the first winding induces a voltage across two terminals of the second winding. The second winding includes a shield. A voltage source is coupled to the shield.

Illustratively according to this aspect of the invention, the voltage source includes an amplifier having an input port and an output port. The input port of the amplifier is coupled to the second winding between the two terminals. The output port of the amplifier is coupled to the shield.

Further illustratively according to this aspect of the invention, the amplifier includes a voltage follower amplifier.

DETAILED DESCRIPTIONS OF ILLUSTRATIVE EMBODIMENTS

Figure 1:
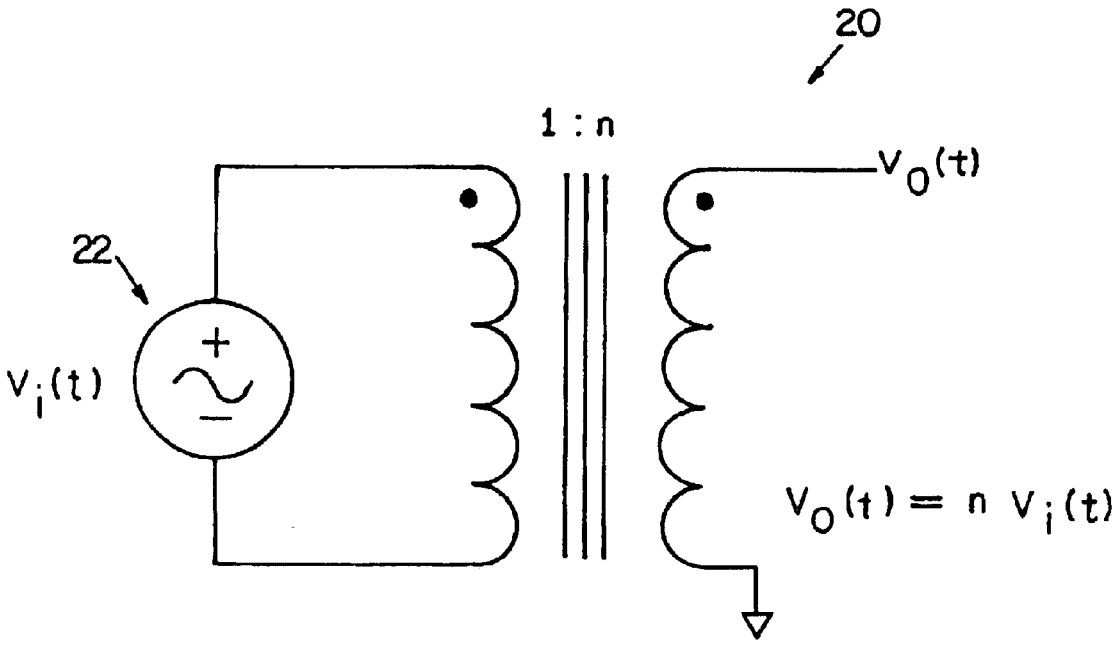
FIG. 1 illustrates an ideal potential transformer configuration.
Figure 2:
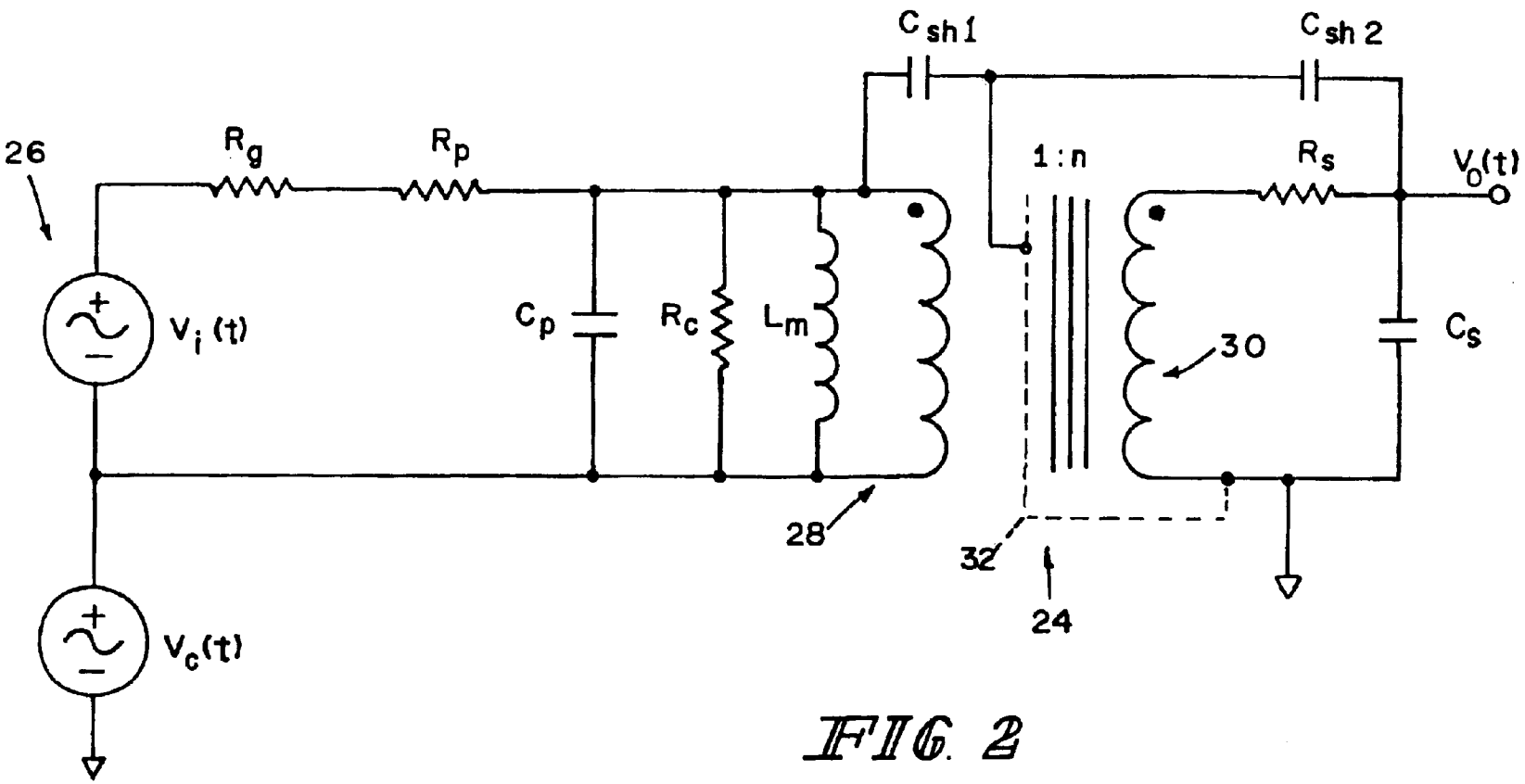
FIG. 2 illustrates a typical model for a non-ideal potential transformer and voltage source.

The magnetizing inductance, $L_m$, and core loss resistance, $R_c$, of a potential transformer 24 can be reduced by several different techniques. Electronic compensation of the core can reduce these effects to manageable levels. Consequently, $L_m$ and $R_c$ can be removed from the model illustrated in FIG. 2. U.S. Pat. No. 5,264,803 teaches methods of winding the transformer 24's windings to reduce the effects of turn-to-turn and layer-to-layer capacitances. Thus, these capacitances can be reduced to manageable levels. Consequently $C_p$ and $C_s$ can also be removed from the model illustrated in FIG. 2. What remain are the effects of winding 28, 30-to-shield 32 capacitance and its interaction with the winding 28, 30 resistance. A somewhat simplified model is thus illustrated in FIG. 3.

Figure 3:
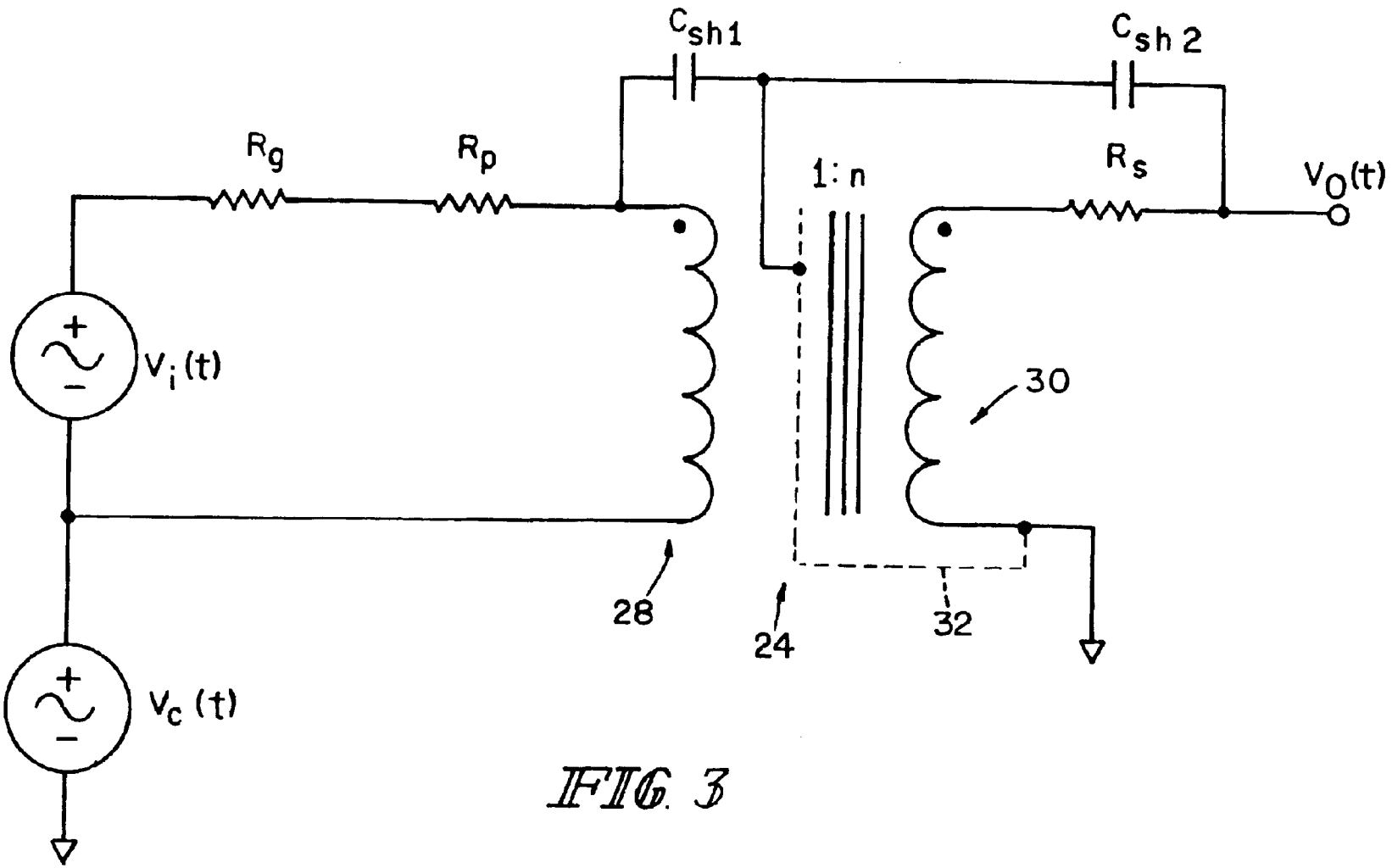
FIG. 3 illustrates a simplified model of the effects of winding-to-shield capacitance and its interaction with the winding resistance.

As FIG. 3 illustrates, both the signal voltage $v_i(t)$ and common mode voltage $v_c(t)$ cause currents to flow in $C_{sh1}$. It is also clear that the signal voltage $v_i(t)$ also causes currents to flow in $C_{sh2}$. Because of the shield 32, the common mode voltage $v_c(t)$ does not directly cause current to flow in $C_{sh2}$ but, $v_c(t)$ can appear in $C_{sh2}$ as a secondary effect through the voltage it induces in $R_p$. Depending upon the magnitudes of the resistance $R_p$ and capacitances $C_{sh1}$, $C_{sh2}$, some of these errors can be quite appreciable. For example, in one step-down transformer currently in production, the primary has a cumulative primary winding resistance of 14.5 KΩ and a cumulative primary winding-to-shield capacitance of 500 pF. If these are assumed to be equivalent to the lumped approximations $R_p$ and $C_{sh1}$ we see that they form a single pole low pass filter having a corner frequency at 22 KHz. At 60 Hz this low pass filter would induce only 3.7 PartsPerMillion of amplitude error but would induce 0.16 degree of phase shift. At the fiftieth harmonic, 3 KHz, these errors are 9200 PPM of amplitude error and 7.8 degrees of phase error. The actual amplitude error and phase shift are smaller because of the distributed nature of the resistance and capacitance, but the amplitude error and phase shift are still quite substantial for a precision measurement device.

Figure 4:
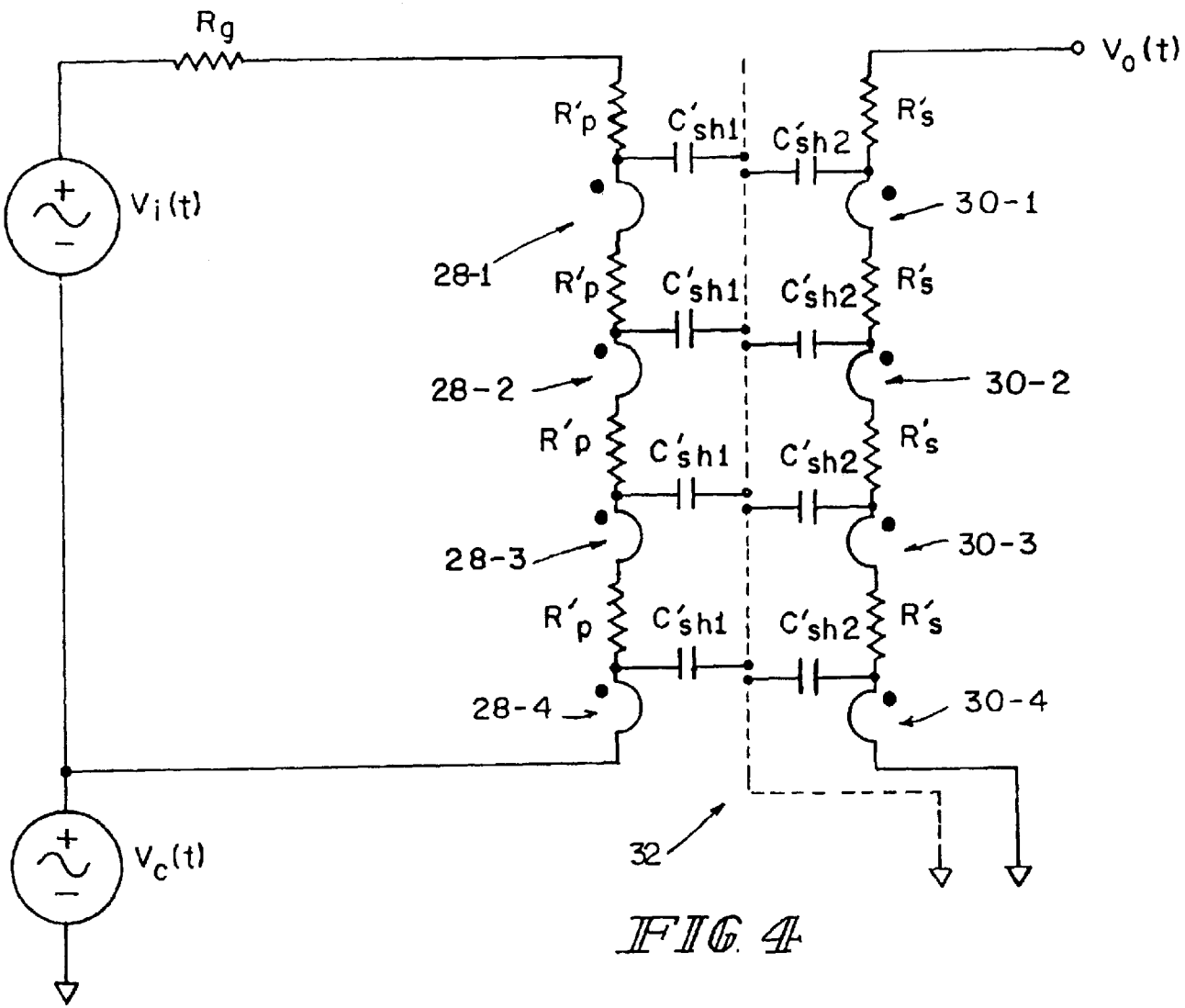
FIG. 4 illustrates the distributed nature of certain transformer parameters; and, FIGS. 5–11 illustrate lumped parameter models useful for understanding the invention.

To reduce this error, the distributed nature of resistance and capacitance may be considered. The model illustrated in FIG. 3 can be revised as illustrated in FIG. 4 to illustrate more clearly the effects of the distributed nature of $R_p$, $R_s$, $C_{sh1}$ and $C_{sh2}$. The primary 28 and secondary 30 windings have been broken, illustratively into four segments 28-1, . . . 28-4 and 30-1, . . . 30-4, respectively, breaking each of $R_p$, $R_s$, $C_{sh1}$, and $C_{sh2}$ into four parts, to more clearly illustrate their distributed nature. It should be recognized that this model can be developed as distributed as desired. For example, the primary and secondary may be divided up into n segments 28-1, 28-2, . . . 28-(n−1), 28-n, 30-1, 30-2, . . . 30-(n−1), 30-n, $R_p$, $R_s$, $C_{sh1}$, and $C_{sh2}$ into n separate resistances and capacitances $R_p$/n, $R_s$/n, $C_{sh1}$/n and $C_{sh}$/n, and so on. It should further be recognized that this is still a lumped parameter approximation. However, it is easier to appreciate from this model the distributed. nature of the components $R_p$, $R_s$, $C_{sh1}$ and $C_{sh2}$. In this model, $R'_p=R_p/4$, $C'_{sh1}=C_{sh1}/4$, and so on. With this somewhat more distributed model it can be appreciated that the voltage across each capacitor $C'_{sh1}$, $C'_{sh2}$ depends upon its location in the winding 28 or 30. The voltage across the top of the winding 28, 30 and the shield 32 can be quite different than that across the bottom of the winding 28, 30 and the shield 32. Thus, current flow through each $R'_p$, $R'_s$, $C'_{sh1}$, and $C'_{sh2}$ is location-dependent.

If the shield 32 could be reconfigured to minimize the voltage across each capacitor $C'_{sh1}$, $C'_{sh2}$, the effects of the stray capacitances $C_{sh1}$ and $C_{sh2}$ can be reduced. One way to accomplish this result is to split the shield 32 into multiple shield portions 32-1, 32-2, . . . 32-n, for example, in half, and drive each portion 32-1, 32-2, . . . 32-n of the shield 32 with a voltage that more closely approximates the voltage on its respective portion of the associated winding. To do this on the primary 28 side, advantage may be made of the fact that, in practical power measurement situations, $R_g$ is typically several orders of magnitude lower than $R_p$ and is capable of driving the shield sections 32-1, 32-2, . . . 32-n directly without any measurable effect.

Figure 5:
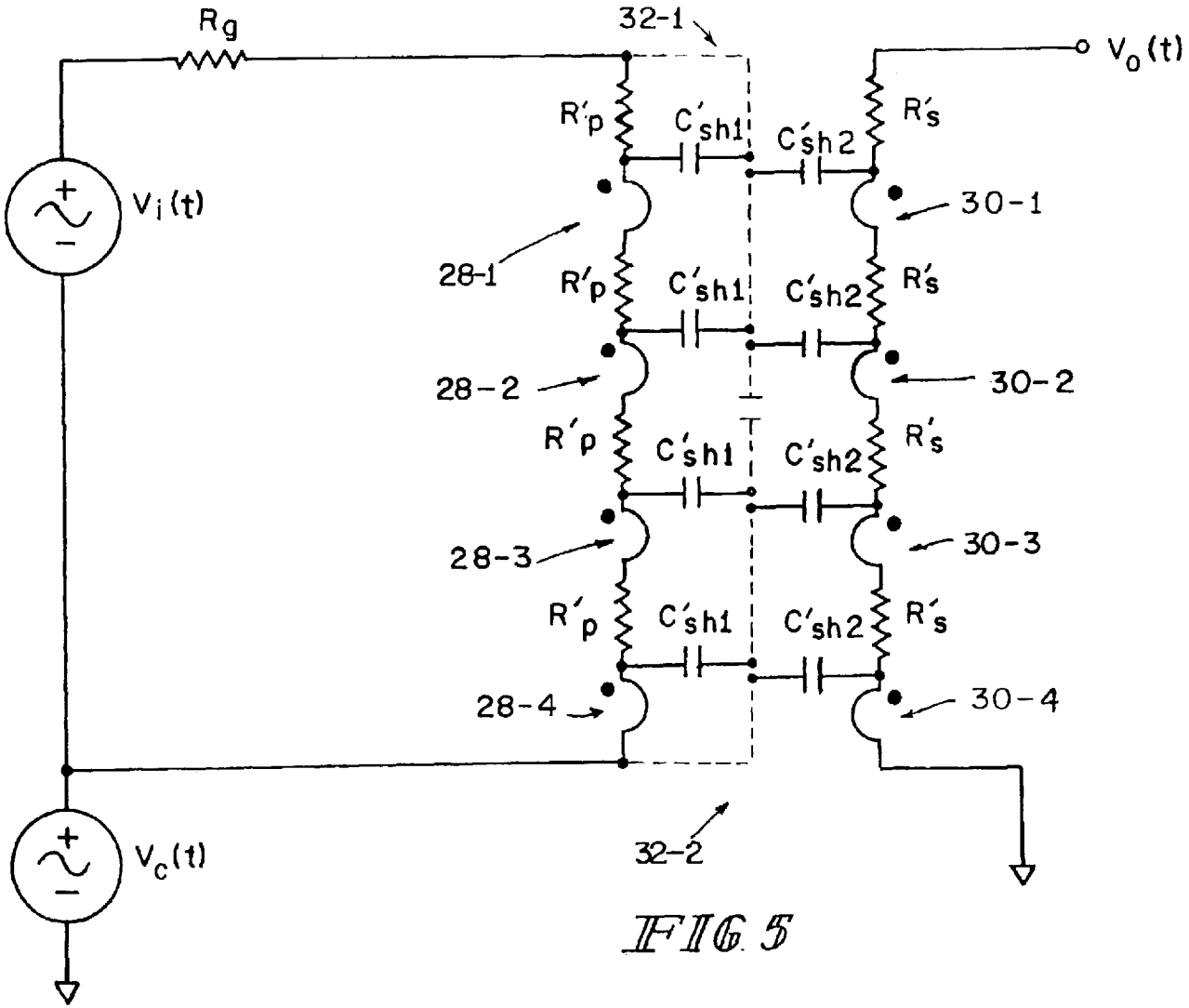

Thus, in the simple, split shield case, the upper part and lower parts 32-1, 32-2, respectively, of the shield 32 may be coupled directly to the $v_i(t)$ generator. This configuration is illustrated in FIG. 5. Using this mechanism, the voltage seen by each capacitor $C'_{sh1}$ on the primary winding 28 side can be reduced. Splitting the primary shield 32 into halves 32-1, 32-2 also halves the total resistance $R_p/2$ and capacitance $C_{sh1}/2$ seen in each half 32-1, 32-2 of the shield 32. Using the lumped approximation model used above for comparison, two single pole filters in cascade are created. Each of the single pole filters includes two resistors with resistances $R'_p$ and two capacitors with capacitances $C'_{sh1}$. Based upon the above assumptions for $R_p$ of 14.5 KΩ and $C_{sh1}$ of 500 pF, the resistors $R'_p$ and capacitors $C'_{sh1}$ would have resistances of 7.25 KΩ and capacitances of 250 pF, respectively. Each $R'_p$-$C'_{sh1}$ pair forms a single pole low pass filter having a corner frequency of 88 KHz. When the two halves are combined with vector addition, they induce an amplitude error of 0.23 PPM and a phase shift of 0.039 degrees. A similar improvement occurs at the fiftieth harmonic, 3 KHz. This is a substantial improvement over the unitary shield.

Figure 6:
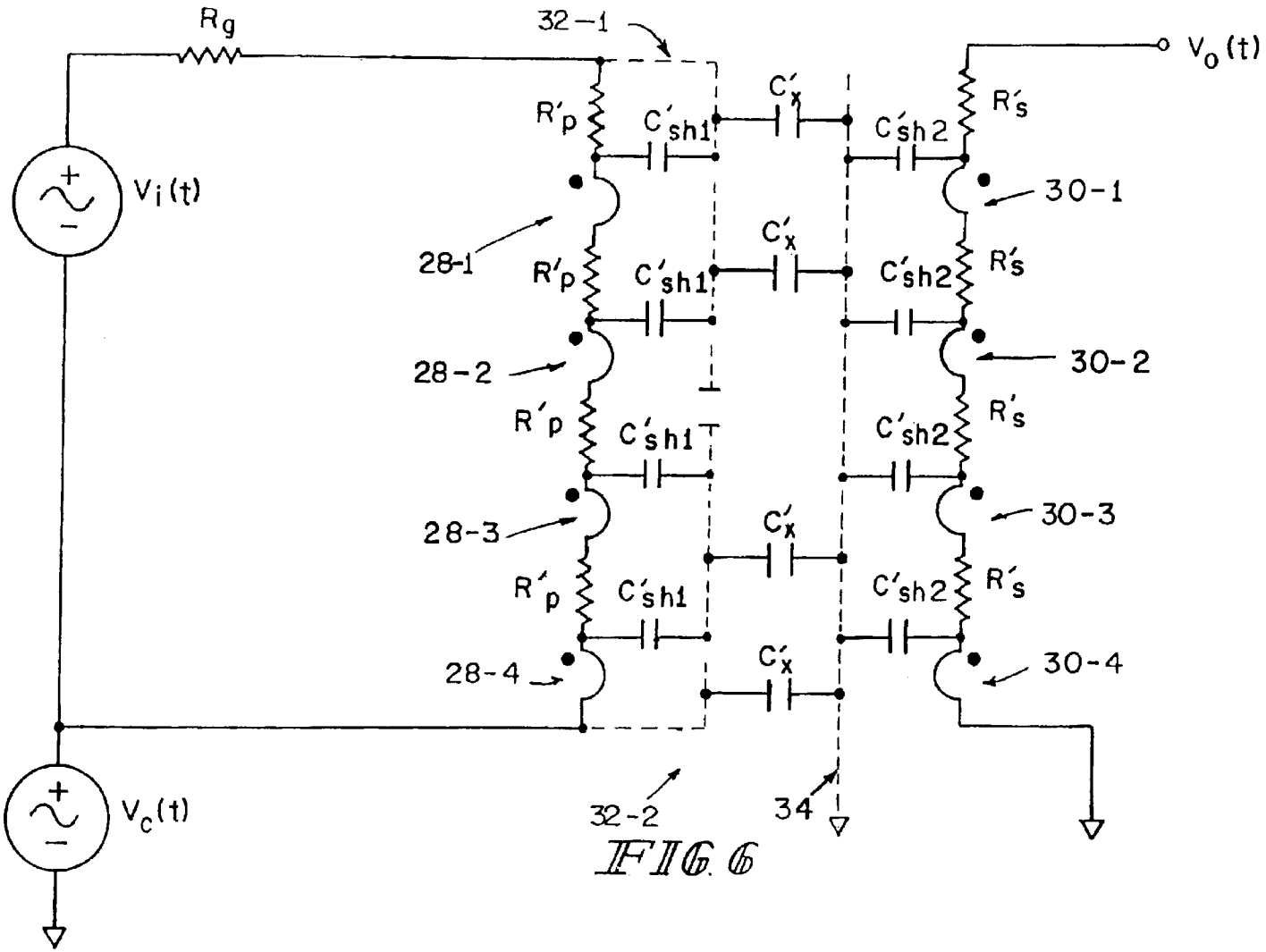

This technique of restructuring the location and attachment of the shield 32 improves the effects of winding 28-to-shield 32 capacitance for the primary 28. However, it results in removal of the shield between the primary 28 and the secondary 30 windings. Depending upon the relative voltages of the two windings 28, 30 and the values of $R_s$, and $C_{sh2}$, this modification may result in error. This error can be reduced by restoring the original electrostatic shield 34. This is illustrated in FIG. 6. Thus, FIG. 6 contemplates three separate electrostatic shield sections. Electrostatic shields 32-1 and 32-2 are associated with the primary winding 28 and electrostatic shield 34 is associated with the secondary winding 30. Voltages generated by the signal voltage $v_i(t)$ and common mode voltage $v_c(t)$ are no longer directly coupled to the secondary winding 30 through $C'_{sh2}$. The only cost, other than increased shield 32-1, 32-2, 34 complexity, is added distributed capacitance $C'_x$ between the shields 32-1, 32-2 and 34. The magnitude of the total capacitance $C_x$ is generally on the same order of magnitude as the original capacitance $C_{sh1}$. However, $C_x$ is connected directly to the voltage source instead of through $R_p$. This will result in error-producing current to flow only in $R_g$, the value of which is typically negligible because of $R_g$'s typically low resistance.

Figure 7:
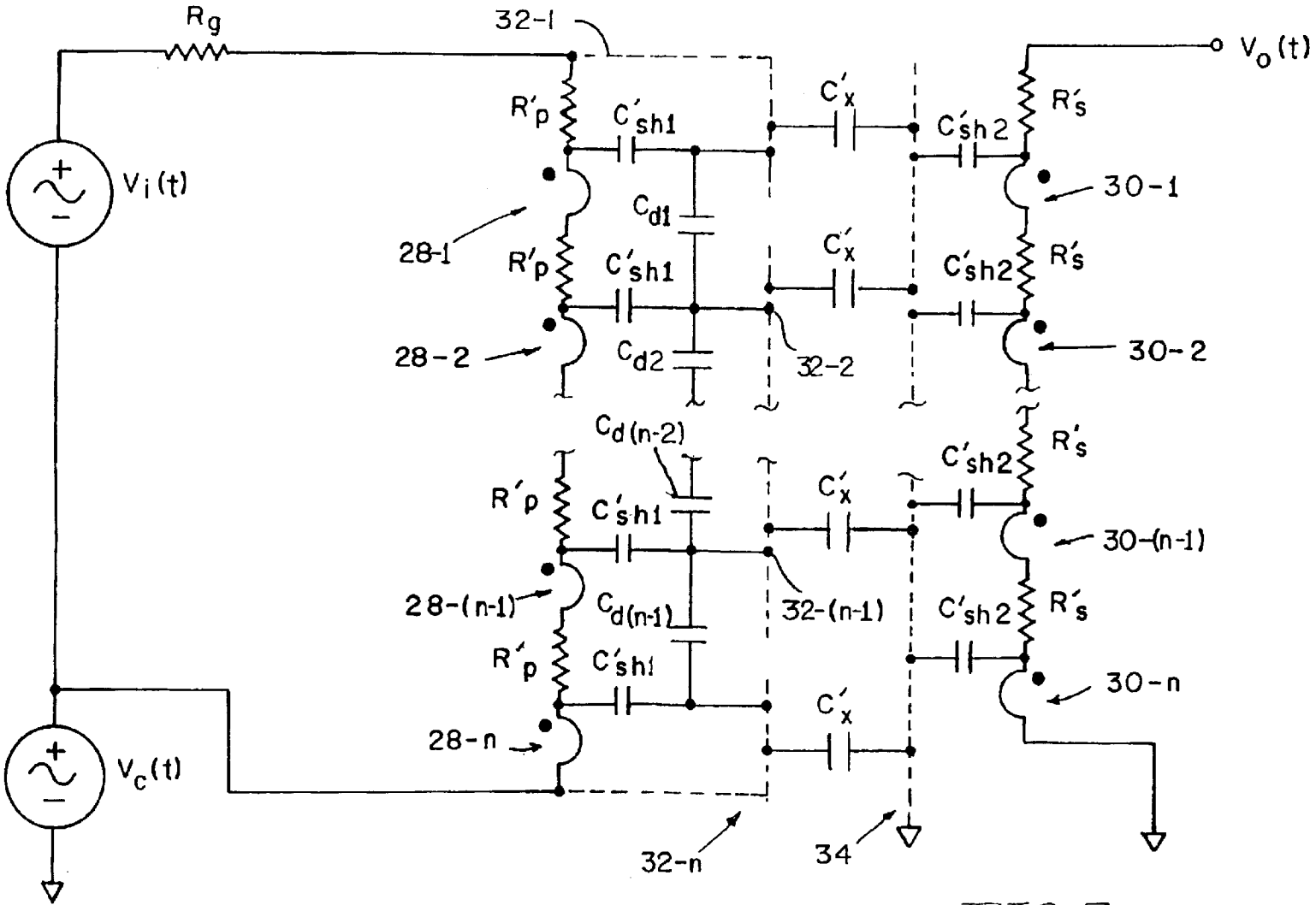
Figure 8:
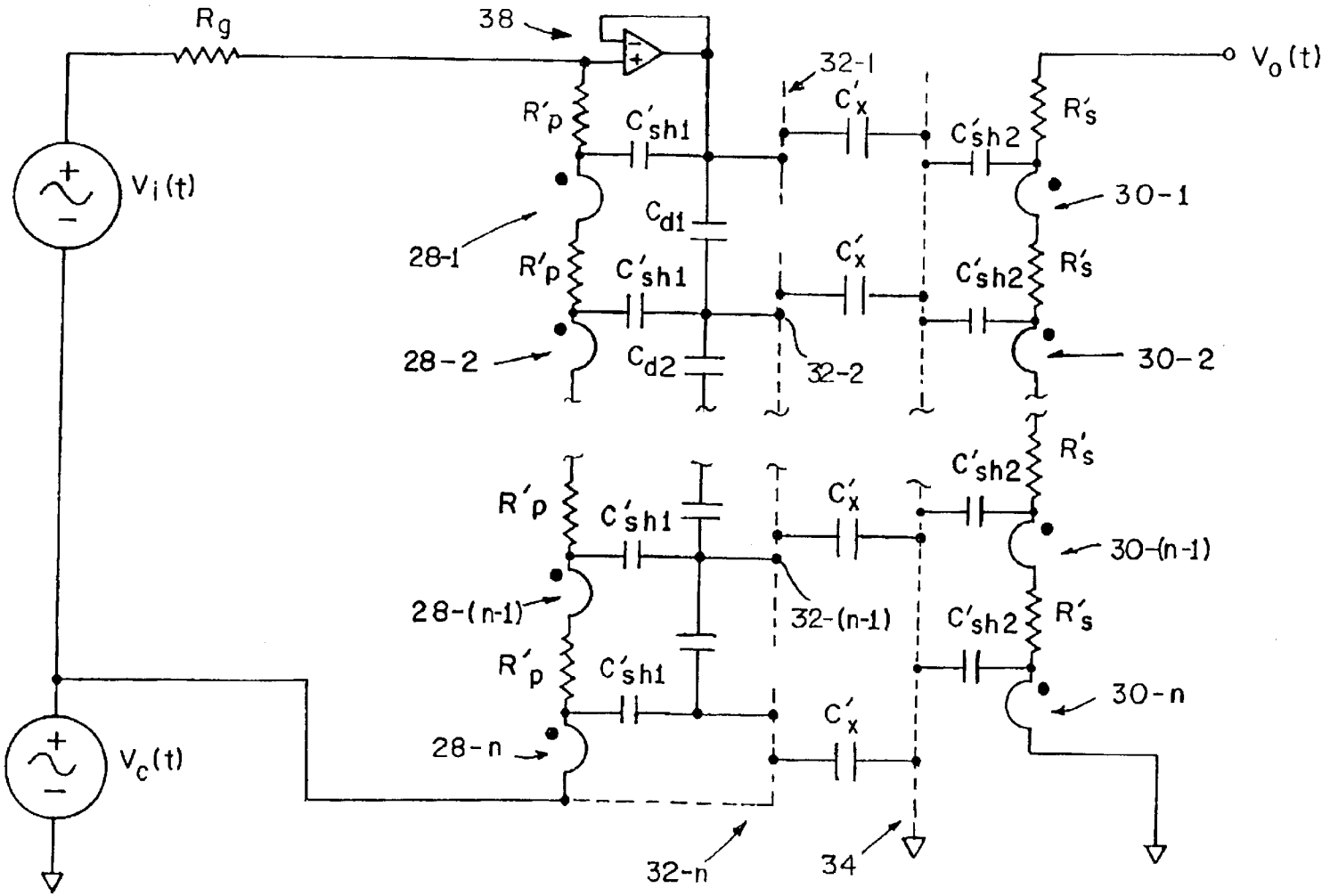
Figure 9:
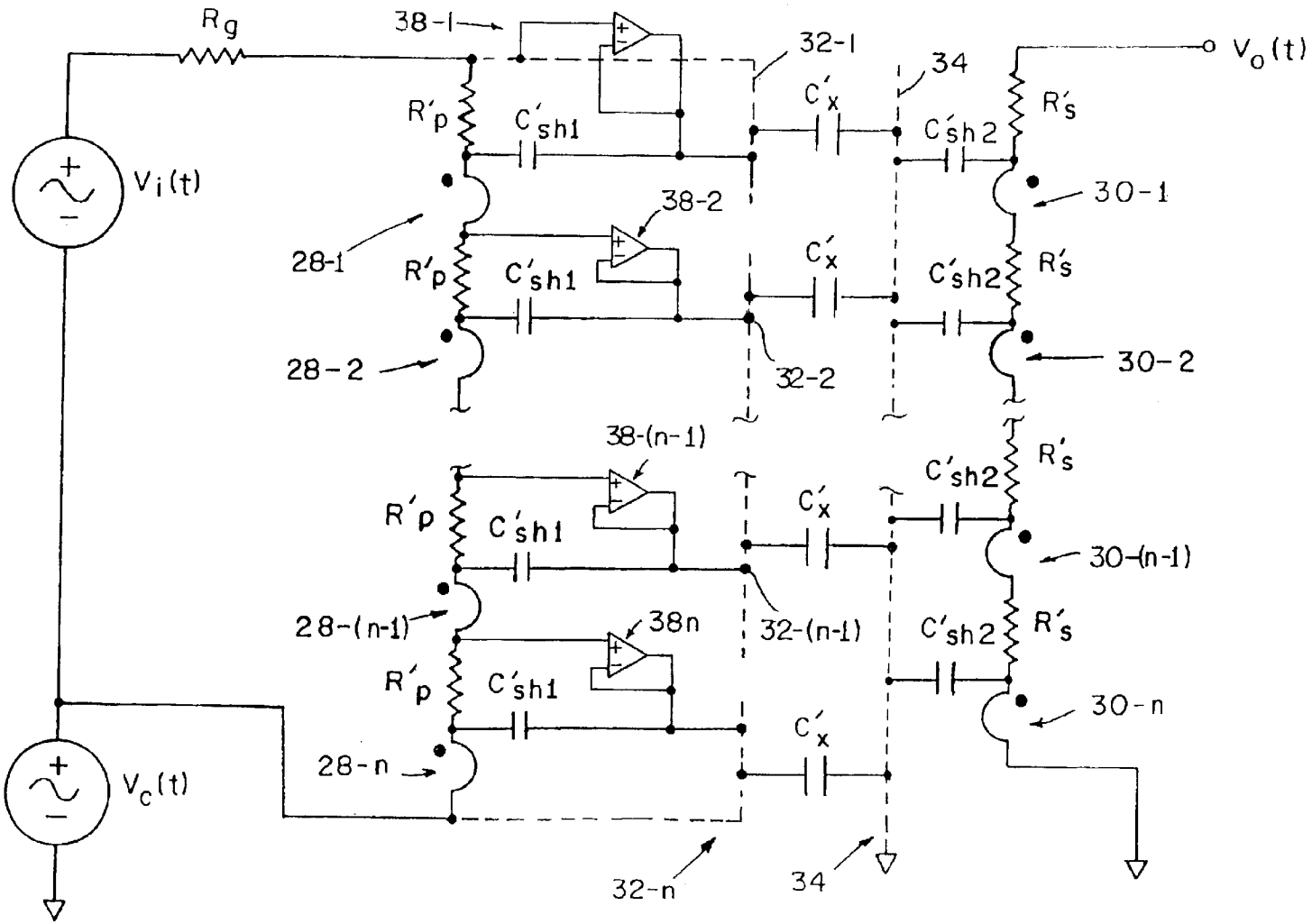

The improvement to the primary winding 28-to-shield 32 capacitance previously discussed does not need to be limited to only a two-section split primary shield. With the addition of additional drive elements for each shield section, the shield 32 can be split into as many sections 32-1, 32-2, . . . 32-n as are needed to achieve the desired results. This is the general case. The improvements discussed in connection with FIG. 6 can be viewed as a subset of this case. Development of this embodiment using a divider chain of discrete capacitors, $C_{d1}$, $C_{d2}$, . . . $C_{d(n-1)}$, to drive the multiple shield sections 32-1, 32-2, . . . 32-n is illustrated in FIG. 7. The divider chain of discrete capacitors, $C_{d1}$, $C_{d2}$, . . . $C_{d(n-1)}$, is connected across the source voltage and divides the source voltage by n. The values of the capacitors $C_{d1}$, $C_{d2}$, . . . $C_{d(n-1)}$, are as nearly the same as practical. There are (n−1) capacitors. The values of the (n−1) capacitors need to be large enough to swamp the individual winding-to-shield capacitances $C'_{sh1}$. A factor of ten will generally suffice. Because of the relatively low impedance of the source and the relatively low capacitance of the $C_{d1}$, $C_{d2}$, . . . $C_{d(n-1)}$ divider chain, this capacitor divider can generally be added without detrimental effect. The only practical penalty is the increasing complexity of the construction. The drive to the individual sections does not need to be provided by a capacitor divider string $C_{d1}$, $C_{d2}$, . . . $C_{d(n-1)}$. If lower load on the source voltage is required and active circuitry is available, an operational amplifier, hereinafter op-amp, 38 input voltage follower could be used to drive a divider string. This is illustrated in FIG. 8. A series of op-amps 38-1, 38-2, . . . 38-(n−1) could also be used to drive the shield 32 sections 32-1, 32-2, . . . 32-(n−1), 32-n individually. This is illustrated in FIG. 9.

Figure 10:
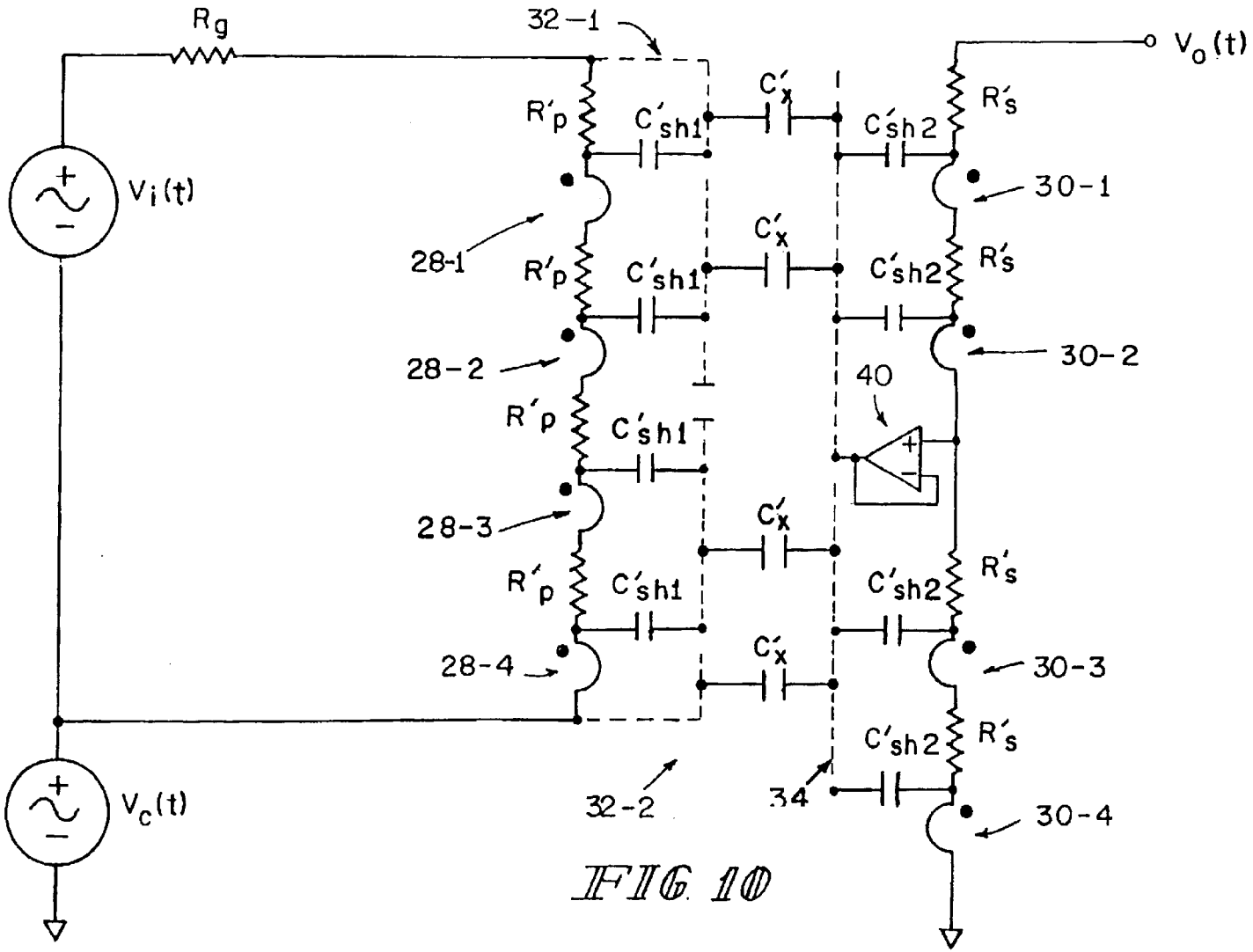

Turning to the issue of the winding 30-to-shield 34 capacitance in the secondary winding 30, unlike the primary winding 28 there is no inherently low impedance source generator to drive the shield 34. However, this problem can be overcome using active circuitry. This is illustrated in FIG. 10. Here, the secondary 30 shield 34 is driven to reduce the voltages to the $C'_{sh2}$ capacitors without the need to split the secondary 30 shield 34. An op-amp 40 is configured as a unity gain follower, the input port of which is coupled to the midpoint of the secondary winding 30. The secondary shield 34 is uncoupled from ground and coupled to the output of the op-amp 40. This provides a low output impedance voltage source 40 at half the voltage at the ungrounded end of the secondary winding 30. As can be seen from FIG. 10, similar reductions in voltages, capacitances, and resistances as those accomplished using the split shield 32-1, 32-2 on the primary 28 are achieved with this combination. A similar improvement in performance also occurs.

These results have been achieved without having to split the shield 34 into multiple sections. While the driven 40 shield 34 embodiment may also be applied to the shield 32 surrounding the primary winding 28 to avoid a multiple shield section 32-1, 32-2, . . . 32-n primary 28, the availability of a low impedance $R_g$ voltage source $v_i(t)$ for the primary 28 and the cost of op-amps make the split primary shield 32-1, 32-2, . . . 32-n a quite acceptable alternative. Although FIG. 10 illustrates the primary 28 with a split shield 32-1, 32-2, . . . 32-n, it should be understood that any form of primary 28 shielding could be used with the secondary 30 shield configuration illustrated in FIG. 9.

Figure 11:
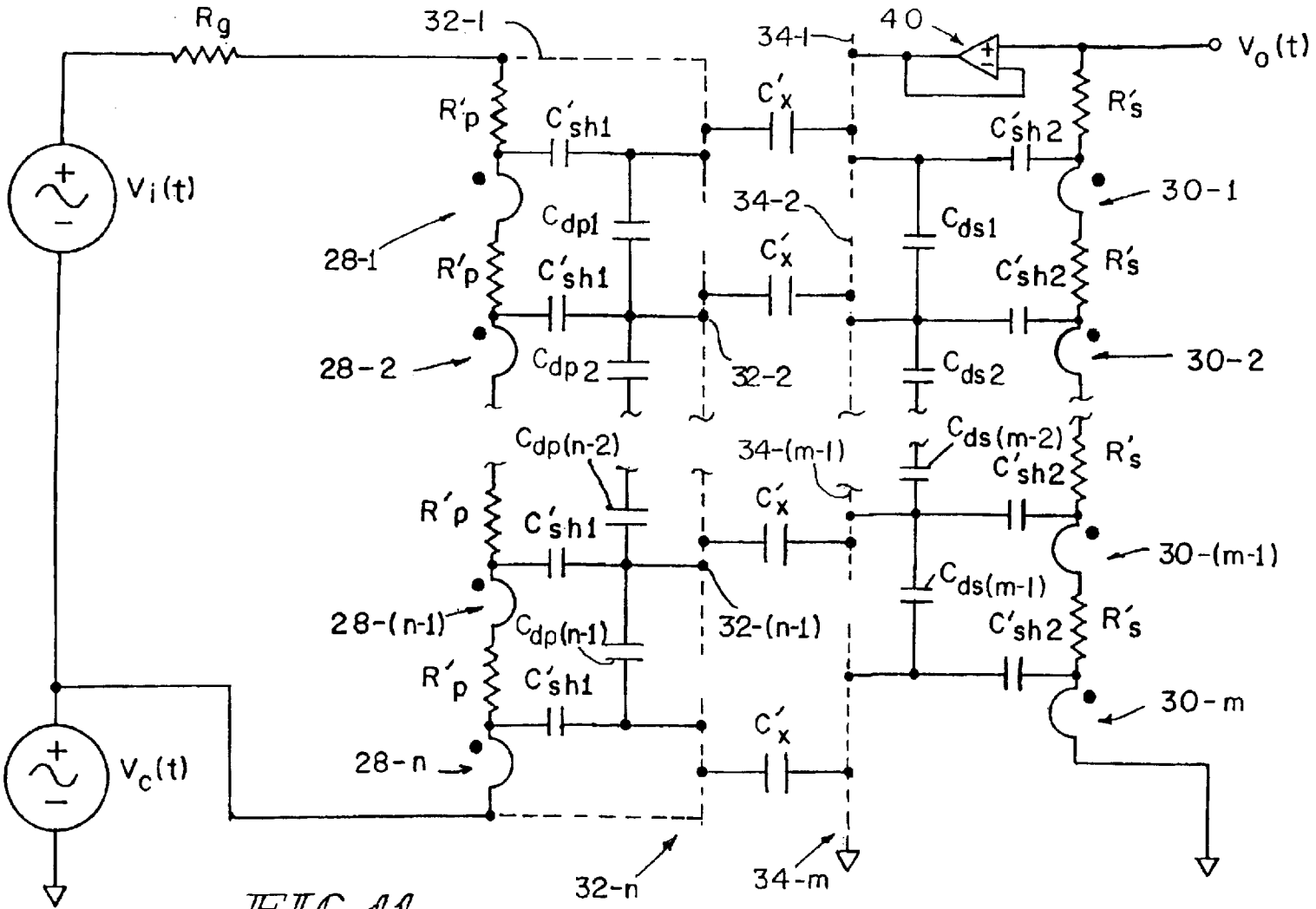

A unity gain op-amp 40 follower can be employed as the low impedance source. If the follower 40 is coupled to the high voltage end of the secondary 30 and its output port is used to drive the top shield section 34-1 and the divider chain of capacitors $C_{d1}$, $C_{d2}$. . . $C_{d(m-1)}$ which drive the remaining shield sections 34-2, . . . 34-(m−1), 34-m, the general case described for the primary winding is implemented in the secondary winding. This is illustrated in FIG. 11. Again, the primary 28 is also illustrated with a general solution. From the general solutions, a specific solution for each winding 28, 30 can be determined based upon, for example, specific voltage, accuracy and size needs of the transformer 24.

What is claimed is:

1. A transformer including a primary winding and a secondary winding coupled to the primary winding through a magnetic circuit so that voltage applied across the primary winding induces a voltage across the secondary winding, the primary winding including at least first and second separate shield portions, the first shield portion shielding only a first portion of the primary winding and the second shield portion shielding only a second portion of the primary winding, each of the first and second shield portions being electrically coupled to the other of the first and second shield portions substantially only through coupling of each of said first and second shield portions to the primary winding, the primary winding, and the other of the first and second shield portions' coupling to the primary winding.

2. The apparatus of claim 1 including n separate shield portions, where n is an integer, each of the n shield portions being electrically coupled to another of the n shield portions substantially only through its coupling to the primary winding, the primary winding and the other of the n shield portions' coupling to the primary winding.

3. A transformer including a first winding and a second winding coupled to the first winding through a magnetic circuit so that voltage applied across the first winding induces a voltage across the second winding, the first winding including at least first and second separate shield portions, the first shield portion shielding only a first portion of the first winding and the second shield portion shielding only a second portion of the first winding, each of the first and second shield portions being electrically coupled to the other of the first and second shield portions substantially only through coupling of each of said first and second shield portions to the first winding, the first winding, and the other of the first and second shield portions' coupling to the first winding, a source for exciting the first winding, the source having an output impedance, the first winding having an input impedance, the output impedance being at least about an order of magnitude less than the input impedance at an output frequency of the source.

4. The apparatus of claim 3 wherein the output impedance is at least about two orders of magnitude less than the input impedance at the output frequency.

5. The apparatus of claim 3 wherein the source includes a source for coupling directly to the first and second shield portions.

6. The apparatus of claim 4 wherein the source includes a source for coupling directly to the first and second shield portions.

7. A transformer including a primary winding and a secondary winding coupled to the primary winding through a magnetic circuit so that voltage applied across the primary winding induces a voltage across the secondary winding, the primary winding including at least first and second separate shield portions, the first shield portion shielding only a first portion of the primary winding and the second shield portion shielding only a second portion of the primary winding, each of the first and second shield portions being electrically coupled to the other of the first and second shield portions substantially only through coupling of each of said first and second shield portions to the primary winding, the primary winding, and the other of the first and second shield portions' coupling to the primary winding, a third shield portion, the third shield portion substantially shielding the secondary winding from the primary winding, the third shield portion being coupled to a reference potential.

8. A transformer including a first winding and a second winding coupled to the first winding through a magnetic circuit so that voltage applied across the first winding induces a voltage across the second winding, the first winding including n separate shield portions, where n is an integer, a series capacitive voltage divider including (n−1) capacitances, each of the n separate shield portions shielding only a respective portion of the first winding, each of the (n−1) capacitances coupling a respective pair of adjacent shield portions, each of the n shield portions being electrically coupled to an adjacent one of the n shield portions substantially only through coupling of each of the adjacent ones of the n separate shield portions to the first winding, the first winding, and the other of the adjacent ones of the n shield portions' coupling to the first winding, and through a respective one of the (n−1) capacitances.

9. The apparatus of claim 8 further including a source for exciting the first winding, the first winding and the series capacitive voltage divider being coupled across the source.

10. The apparatus of claim 8 further including a first source for exciting the first winding and a second source, the first winding being coupled across the first source and the capacitive voltage divider being coupled across the second source.

11. The apparatus of claim 10 wherein the second source includes an amplifier.

12. The apparatus of claim 11 wherein the amplifier includes a voltage follower amplifier.

13. A transformer including a first winding and a second winding coupled to the first winding through a magnetic circuit so that voltage applied across the first winding induces a voltage across the second winding, the first winding including n separate shield portions, where n is an integer, each of the n separate shield portions shielding only a respective portion of the first winding, each of the n separate shield portions being electrically coupled to an adjacent one of the n separate shield portions substantially only through coupling of each of the adjacent ones of the n separate shield portions to the first winding, the first winding, and the other of the adjacent ones of the n shield portions' coupling to the first winding, n sources, the first winding being coupled across a first one of the n sources for exciting the first winding, and each of the (n−1) additional sources being coupled to a respective one of (n−1) of the n separate shield portions.

14. The apparatus of claim 13 wherein each of the (n−1) additional sources includes an amplifier.

15. A transformer including a first winding and a second winding coupled to the first winding through a magnetic circuit so that voltage applied across the first winding induces a voltage across the second winding, the first winding including n separate shield portions, where n is an integer, a series capacitive voltage divider including (n−1) capacitances, each of the (n−1) capacitances coupling a respective pair of adjacent shield portions of the first winding, each of the n shield portions of the first winding being electrically coupled to an adjacent one of the n shield portions of the first winding substantially only through its coupling to the first winding, the first winding, and the adjacent one of the n shield portions' coupling to the first winding, and through a respective one of the (n−1) capacitances, the second winding including m separate shield portions, where m is an integer, a series capacitive voltage divider including (m−1) capacitances, each of the (m−1) capacitances coupling a respective pair of adjacent shield portions of the second winding, each of the m shield portions of the second winding being electrically coupled to an adjacent one of the m shield portions of the second winding substantially only through its coupling to the second winding, the second winding, and the adjacent one of the m shield portions' coupling to the second winding, and through a respective one of the (m−1) capacitances.

16. The apparatus of claim 15 further including a source for coupling across the (m−1) series voltage divider capacitances.

17. The apparatus of claim 15 further including a source for coupling across the (n−1) series voltage divider capacitances.

18. The apparatus of claim 15 further including a first source for coupling across the (n−1) series voltage divider capacitances and a second source for coupling across the (m−1) series voltage divider capacitances.

19. A transformer including a first winding and a second winding coupled to the first winding through a magnetic circuit so that current through the first winding induces a voltage across two terminals of the second winding, the second winding including a shield, and a voltage source coupled to the shield.

20. The apparatus of claim 19 wherein the voltage source includes an amplifier having an input port and an output port, the input port being coupled to the second winding between the two terminals, and the output port being coupled to the shield.

21. The apparatus of claim 20 wherein the amplifier includes a voltage follower amplifier.

* * * * *